US006601367B1

(12) United States Patent
Weder et al.

(10) Patent No.: US 6,601,367 B1
(45) Date of Patent: Aug. 5, 2003

(54) METHOD OF COVERING A POT OR FLORAL GROUPING WITH A SLEEVE HAVING A CONCAVE LOWER END

(75) Inventors: Donald E. Weder, Highland, IL (US); Joseph G. Straeter, Highland, IL (US); Paul Fantz, Imperial, MO (US)

(73) Assignee: Southpac Trust International, Inc.

( * ) Notice: Subject to any disclaimer, the term of this patent is extended or adjusted under 35 U.S.C. 154(b) by 132 days.

(21) Appl. No.: 09/941,994

(22) Filed: Aug. 29, 2001

(51) Int. Cl.[7] ..... B65B 25/02

(52) U.S. Cl. ..... 53/397; 47/72; 53/412; 53/413; 53/459; 206/423; 229/87.01; 383/907

(58) Field of Search ..... 53/397, 412, 413, 53/459, 390; D9/305; 47/72; 206/423; 229/87.01; 383/120, 121, 907

(56) References Cited

U.S. PATENT DOCUMENTS

| | | | | |
|---|---|---|---|---|
| 524,219 | A | 8/1894 | Schmidt | |
| 732,889 | A | 7/1903 | Paver | |
| 950,785 | A | 3/1910 | Pene | |
| 1,044,260 | A | 11/1912 | Schloss | |
| 1,063,154 | A | 5/1913 | Bergen | |
| 1,446,563 | A | 2/1923 | Hughes | |
| 1,520,647 | A | 12/1924 | Hennigan | |
| 1,525,015 | A | 2/1925 | Weeks | |
| 1,610,652 | A | 12/1926 | Bouchard | |
| 1,697,751 | A | 1/1929 | Blake | |
| 1,794,212 | A | 2/1931 | Snyder | |
| 1,804,447 | A * | 5/1931 | Wagner | 47/41.01 |
| 1,811,574 | A | 6/1931 | Barrett | |
| 1,863,216 | A | 6/1932 | Wordingham | |
| 1,978,631 | A | 10/1934 | Herrlinger | |
| 2,048,123 | A | 7/1936 | Howard | |
| RE21,065 | E | 5/1939 | Copeman | |
| 2,170,147 | A | 8/1939 | Lane | |
| 2,200,111 | A | 5/1940 | Bensel | |
| D125,195 | S * | 2/1941 | Winsick | D9/305 |
| 2,278,673 | A | 4/1942 | Savada et al. | |
| 2,302,259 | A | 11/1942 | Rothfuss | |
| 2,323,287 | A | 7/1943 | Amberg | |

(List continued on next page.)

FOREIGN PATENT DOCUMENTS

| | | |
|---|---|---|
| AU | 4231978 | 6/1979 |
| BE | 654427 | 1/1965 |
| CH | 560532 | 4/1975 |

(List continued on next page.)

OTHER PUBLICATIONS

Speed Cover Brochure, "The Simple Solution For Those Peak Volume Periods", Highland Supply Corporation, ® 1989.

"Speed Sheets and Speed Rolls" Brochure, Highland Supply Corporation, ® 1990.

"Color Them Happy with Highlander Products" ® 1992.

"Costa Keeps the Christmas Spirit", Supermarket Floral, Sep. 15, 1992.

(List continued on next page.)

*Primary Examiner*—Stephen F. Gerrity
(74) *Attorney, Agent, or Firm*—Dunlap, Codding & Rogers

(57) ABSTRACT

A floral sleeve initially having a flattened state and openable therefrom for use in covering, containing or wrapping a floral grouping, botanical item, pot, or pot having a floral grouping or botanical item therein. The sleeve has a concave lower end having an inwardly curved lower edge, and may have a detachable upper portion. The sleeve may have a non-linear or linear upper edge. When having a detachable upper portion, the sleeve has a detaching element which, when employed to detach the upper portion, leaves a linear or non-linear upper edge on the lower portion of the sleeve. The concave lower end of the sleeve may have a gusset therein.

23 Claims, 4 Drawing Sheets

U.S. PATENT DOCUMENTS 2,355,559 A 8/1944 Renner
2,371,985 A 3/1945 Freiberg
2,411,328 A 11/1946 MacNab
2,510,120 A 6/1950 Leander
2,529,060 A 11/1950 Trillich
2,621,142 A 12/1952 Wetherell
2,648,487 A 8/1953 Linda
2,688,354 A 9/1954 Berger
2,774,187 A 12/1956 Smithers
2,822,287 A 2/1958 Avery
2,846,060 A 8/1958 Yount
2,850,842 A 9/1958 Eubank, Jr.
2,883,262 A 4/1959 Borin
2,989,828 A 6/1961 Warp
3,022,605 A 2/1962 Reynolds
3,080,680 A 3/1963 Reynolds et al.
3,094,810 A 6/1963 Kalpin
3,121,647 A 2/1964 Harris et al.
3,130,113 A 4/1964 Silman
3,271,922 A 9/1966 Wallerstein et al.
3,317,118 A * 5/1967 Harrison et al. ..... 383/907
3,322,325 A 5/1967 Bush
3,376,666 A 4/1968 Leonard
3,380,646 A 4/1968 Doyen et al.
3,431,706 A 3/1969 Stuck
3,441,198 A * 4/1969 Ericson ..... 383/907
3,508,372 A 4/1970 Wallerstein et al.
3,510,054 A 5/1970 Sanni et al.
3,512,700 A 5/1970 Evans et al.
3,550,318 A 12/1970 Remke et al.
3,552,059 A 1/1971 Moore
3,554,434 A 1/1971 Anderson
3,556,389 A 1/1971 Gregoire
3,557,516 A 1/1971 Brandt
3,587,844 A * 6/1971 Wing ..... 206/554
3,620,366 A 11/1971 Parkinson et al.
3,630,430 A * 12/1971 Struble ..... 229/117.03
3,681,105 A 8/1972 Milutin et al.
3,767,104 A 10/1973 Bachman et al.
3,793,799 A 2/1974 Howe et al.
3,869,828 A 3/1975 Matsumoto
3,888,443 A 6/1975 Flanigen
3,962,503 A 6/1976 Crawford
4,043,077 A 8/1977 Stonehocker
4,054,697 A 10/1977 Reed et al.
4,091,925 A 5/1978 Griffo et al.
4,113,100 A 9/1978 Soja et al.
4,118,890 A 10/1978 Shore
4,189,868 A 2/1980 Tymchuck et al.
4,216,620 A 8/1980 Weder et al.
4,248,347 A 2/1981 Trimbee
D259,333 S 5/1981 Charbonneau
4,265,049 A 5/1981 Gorewitz
4,280,314 A 7/1981 Stuck
4,297,811 A 11/1981 Weder
4,333,267 A 6/1982 Witte
4,347,686 A 9/1982 Wood
4,380,564 A 4/1983 Cancio et al.
4,400,910 A 8/1983 Koudstall et al.
4,413,725 A 11/1983 Bruno et al.
D279,279 S 6/1985 Wagner
4,546,875 A 10/1985 Zweber
4,621,733 A 11/1986 Harris
4,640,079 A 2/1987 Stuck
4,717,262 A 1/1988 Roen et al.
4,733,521 A 3/1988 Weder et al.
4,765,464 A 8/1988 Ristvedt
4,771,573 A 9/1988 Stengel
4,773,182 A 9/1988 Weder et al.
4,801,014 A 1/1989 Meadows
4,810,109 A 3/1989 Castel
4,835,834 A 6/1989 Weder
D301,991 S 7/1989 Van Sant
4,941,572 A 7/1990 Harris
4,980,209 A 12/1990 Hill
4,989,396 A 2/1991 Weder et al.
D315,700 S 3/1991 Stephens
5,073,161 A 12/1991 Weder et al.
5,074,675 A 12/1991 Osgood
5,105,599 A 4/1992 Weder
5,111,638 A 5/1992 Weder
5,120,382 A 6/1992 Weder
5,152,100 A 10/1992 Weder et al.
5,181,364 A 1/1993 Weder
D335,105 S 4/1993 Ottenwalder et al.
5,199,242 A 4/1993 Weder et al.
5,205,108 A 4/1993 Weder et al.
5,228,234 A 7/1993 de Klerk et al.
5,235,782 A 8/1993 Landau
5,239,775 A 8/1993 Landau
5,249,407 A 10/1993 Stuck
5,259,106 A 11/1993 Weder et al.
5,307,606 A 5/1994 Weder
5,315,785 A 5/1994 Avôt et al.
5,350,240 A 9/1994 Billman et al.
5,353,575 A 10/1994 Stepanek
5,361,482 A 11/1994 Weder et al.
5,388,695 A 2/1995 Gilbert
5,412,906 A * 5/1995 Weder ..... 47/72
5,428,939 A 7/1995 Weder et al.
5,443,670 A 8/1995 Landau
5,493,809 A 2/1996 Weder et al.
D368,025 S 3/1996 Sekerak et al.
5,496,251 A 3/1996 Cheng
5,496,252 A 3/1996 Gilbert
5,526,932 A 6/1996 Weder
5,551,570 A 9/1996 Shaffer et al.
D374,204 S * 10/1996 Weder ..... D9/305
5,572,849 A 11/1996 Weder et al.
5,572,851 A 11/1996 Weder
5,575,133 A 11/1996 Weder et al.
5,617,703 A 4/1997 Weder
5,624,320 A 4/1997 Martinez
5,625,979 A 5/1997 Weder
5,647,168 A 7/1997 Gilbert
5,647,193 A 7/1997 Weder et al.
5,715,944 A 2/1998 Windisch
D404,684 S 1/1999 Shea
5,974,730 A 11/1999 Chien
D419,436 S 1/2000 Celtorius et al.
6,129,209 A 10/2000 Tchira

FOREIGN PATENT DOCUMENTS

DE 345464 12/1921
DE 513971 12/1930
DE 1166692 3/1964
DE 1962947 6/1971
DE 2060812 11/1971
DE 2748626 5/1979
DE 3445799 6/1986
DE 3829281 5/1989
DE 3911847 10/1990
EP 0050990 5/1982
EP 0791543 8/1997
FR 1376047 9/1964
FR 2036163 12/1970
FR 2137325 12/1972
FR 2272914 12/1975
FR 2489126 3/1982
FR 2610604 8/1988
FR 2603159 3/1989

| | | | | |
|---|---|---|---|---|
| FR | 2619698 | | 3/1989 | |
| FR | 2698080 | A1 * | 5/1994 | ..... B65D/65/30 |
| GB | 5605 | | 5/1885 | |
| GB | 1204647 | | 9/1970 | |
| GB | 2056410 | | 3/1981 | |
| GB | 2074542 | | 11/1981 | |
| GB | 2128083 | | 4/1984 | |
| GB | 2252708 | | 8/1992 | |
| IT | 224507 | | 4/1996 | |
| JP | 5-42958 | | 2/1993 | |
| JP | 5-43001 | A * | 2/1993 | ..... B65F/1/00 |
| NL | 8301709 | | 12/1984 | |
| NL | 1000658 | | 1/1996 | |
| WO | 9315979 | | 8/1993 | |

OTHER PUBLICATIONS

"Super Seller", Supermarket Floral, Sep. 15, 1992.
"Halloween", Link Magazine, Sep. 1992.
"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™ and Florasheet®, published prior to Mar. 31, 1994, 2 pages.
"Stand Alone Plastic Bagmaking" brochure, AMI, Atlanta, GA, Feb. 15, 1996, 2 pages.

"Foil Jackets" brochure, Custom Medallion, Inc., Dec., 1996, 2 pages.

"Derwent Abstract" of FR 2610604A. It is noted that the abstract is an incorrect English translation of the contents of the French patent. The French patent does not enable or disclose adhesively attaching the covering to the container. 1988.

"Silver Linings" Brochure, Affinity Diversified Industries, Inc., 1986. The Silver Linings brochure shows a floral sleeve with a closed bottom. The brochure shows, in one embodiment, a vase with flowers inside a "cut flower" sleeve with the sleeve tied with a ribbon about the neck of the vase.

"Special Occasion Printed Highlophane Bags" Brochure, Highland Supply Corporation, 1990, 2 pages.

"Creative Packaging" Brochure, John Henry Company, Sep. 1992.

"Make Highlander Your Headquarters" Brochure, Highland Supply Corporation, 1991.

* cited by examiner

METHOD OF COVERING A POT OR FLORAL GROUPING WITH A SLEEVE HAVING A CONCAVE LOWER END

RELATED REFERENCES

Not applicable.

FIELD OF THE INVENTION

This invention generally relates to sleeves, and more particularly, to sleeves used to wrap floral groupings or flower pots containing floral groupings and/or mediums containing floral groupings, and methods of using same. U.S. Pat. Nos. 5,625,979 and 5,493,809 and pending U.S. Ser. No. 09/189,033 disclose subject matter which may be relevant to the invention contemplated and claimed herein and each is hereby expressly incorporated herein by reference in its entirety.

DESCRIPTION OF THE PREFERRED EMBODIMENTS

Figure 1:
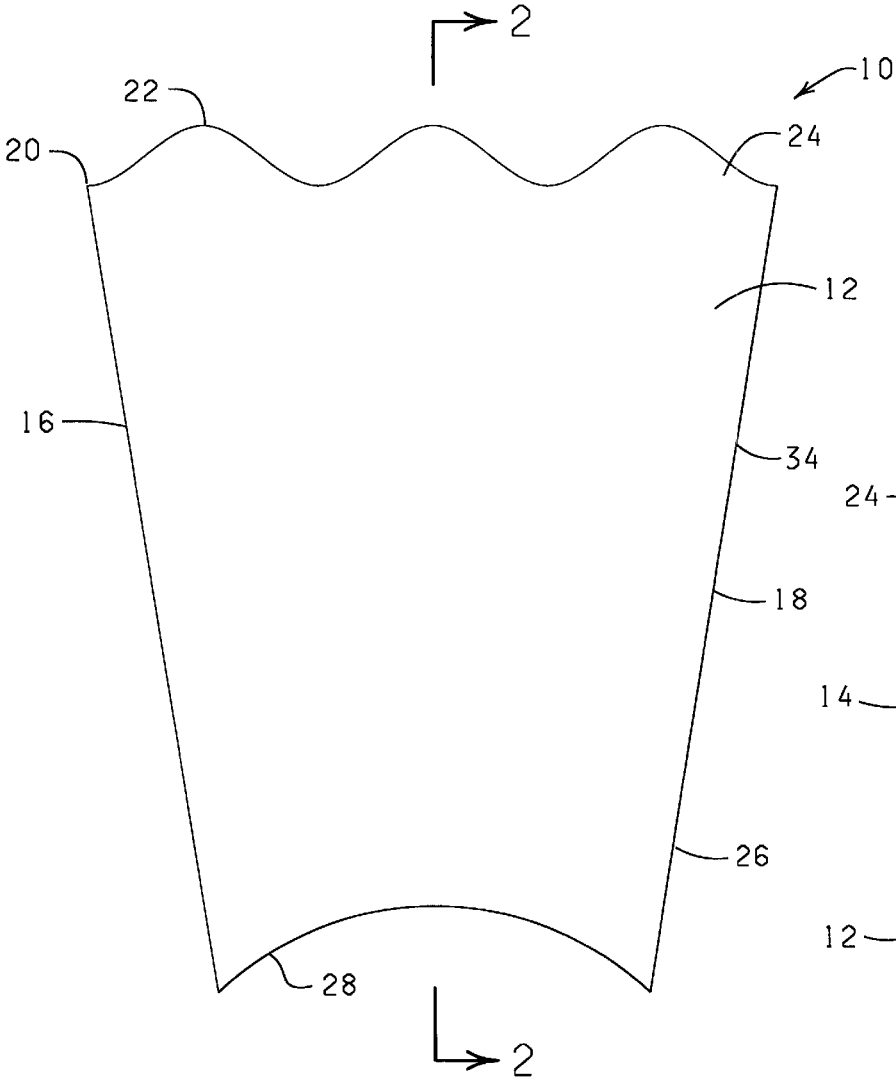
FIG. 1 is an elevational view of a sleeve constructed in accordance with the present invention.
Figure 2:
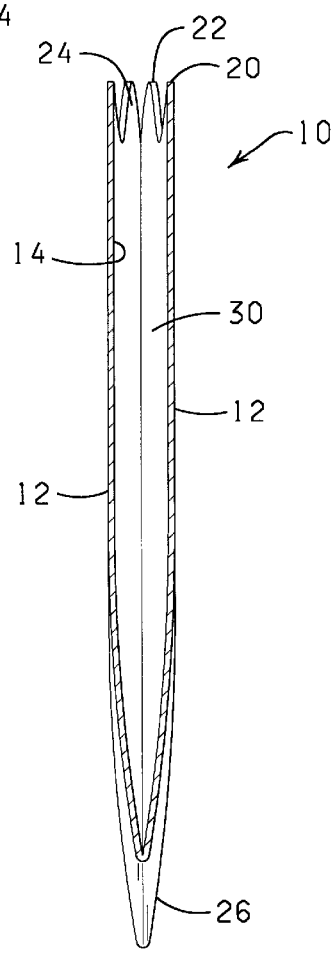
FIG. 2 is a cross-sectional view of the sleeve of FIG. 1 taken along line 2—2 thereof.

The present invention contemplates in a preferred version a preformed sleeve (also referred to herein as a "floral sleeve" or a "sleeve") having a tubular shape sized to contain and generally conform to a flower pot having an upper end, a lower end and an outer peripheral surface. The sleeve may further comprise a lower portion and a detachable upper portion which may be sized to surround and encompass a floral grouping.

The sleeve may form part of a plant package when used in conjunction with a floral grouping or a pot having a floral grouping therein, and wherein the pot and/or floral grouping are substantially surrounded and encompassed by the sleeve. The floral grouping is at least partially surrounded and encompassed and may be entirely enclosed by the upper portion when it forms a part of the preformed sleeve.

The sleeve may have a bonding material disposed on an inner portion thereof for bondingly connecting the sleeve to a pot disposed therein. Alternatively, the bonding material may be disposed on an outer portion of the sleeve for forming a plurality of crimps in a portion of the sleeve.

The lower portion of the sleeve may be constructed from a first material and the upper portion (when present) may be constructed from the first material or a second material different from the first material.

These embodiments and others of the present invention are now described in more detail below. It will be appreciated that the examples provided herein are not intended to limit the scope and extent of the claimed invention but are only intended to exemplify various embodiments of the invention contemplated herein.

Shown in FIGS. 1–4 is a sleeve designated by the general reference numeral 10. The sleeve 10 has an outer peripheral surface 12, an inner peripheral surface 14, an upper end 20 having an upper edge 22, a skirt portion 24, and an inner space 30. The sleeve 10, in a flattened state, also includes a first sidewall edge 16, a second sidewall edge 18, and a concave lower end 26 having an inwardly curved lower edge 28.

The sleeve 10 is initially formed to have a flattened state and is openable therefrom to an open state for containing a floral container, such as a pot as described elsewhere herein. The shape of the concave lower end 26 may be elliptical, rounded, curvilinear, ovoid, or any other curved shape known in the art, but must be inwardly curved. The sleeve 10 is preferably individually sized so that a standard sized flower pot, such as a 3-inch, 3½-inch, 4-inch, 4½-inch, 5-inch, 5½-inch, 6-inch, 6½-inch, 7-inch or 8-inch pot, for example, can fit within the sleeve 10, with the pot preferably substantially conforming to the inner peripheral surface 14 of the sleeve 10. While the sleeve 10 preferably has a tapered, frusto-conical shape, the sleeve 10 may also have a rectangular or cylindrical shape.

Figure 3:
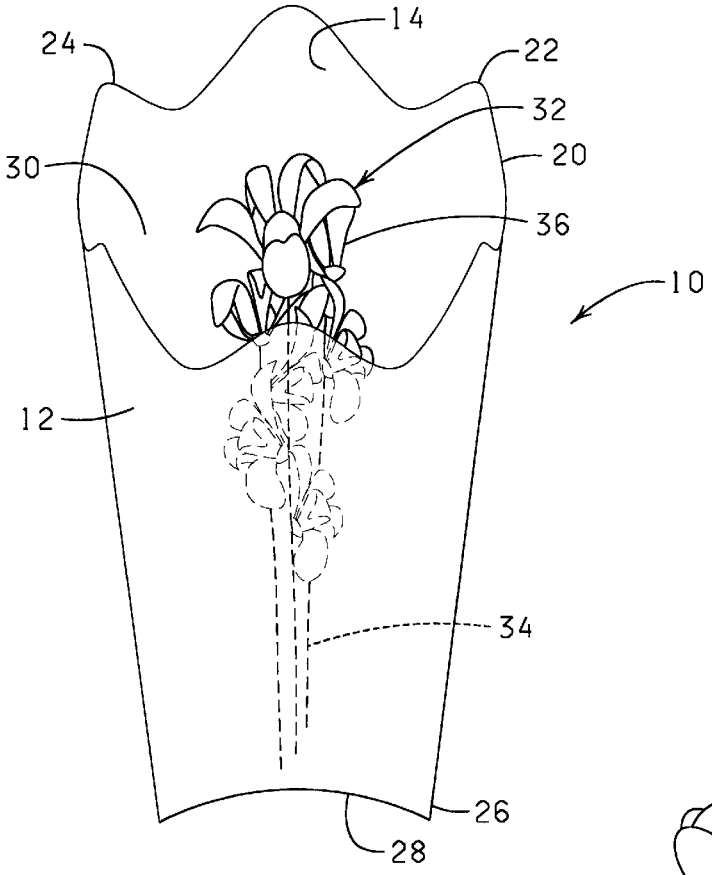
FIG. 3 is a perspective view of the sleeve of FIG. 1 having a floral grouping therein.
Figure 4:
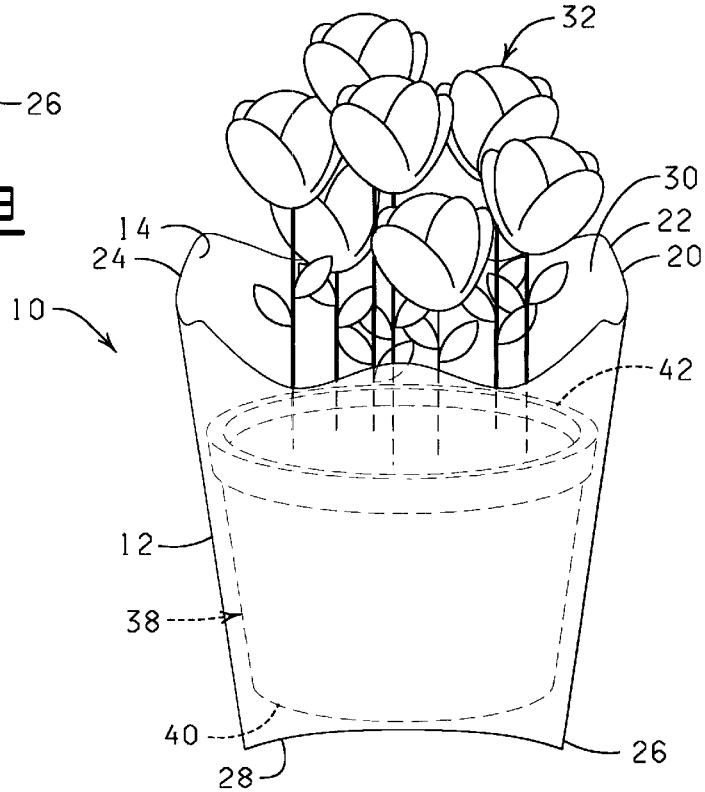
FIG. 4 is a perspective view of the sleeve of FIG. 1 having a pot and floral grouping therein.

In a preferred version of the invention shown in FIGS. 1–4, the upper edge 22 of the upper end 20 of the sleeve 10 has a non-linear pattern such as a curve, wave, arc or serration. The upper edge 22 and the upper end 20 form the skirt portion 24 of the sleeve 10 for decorating a floral grouping 32. The floral grouping 32 has a stem portion 34 and a bloom portion 36 disposed in the sleeve 10 (FIG. 3). The floral grouping 32 may be disposed in a pot 38 having a lower end 40 and an upper end 42 which is disposed within the sleeve 10 (FIG. 4). Other non-linear configurations of the upper edge 22 of the skirt portion 24 will be readily apparent to one of ordinary skill in the art, for example, those shown in FIGS. 11–16 of U.S. Ser. No. 09/401,771, the entire specification of which is hereby expressly incorporated herein by reference.

Figure 5:
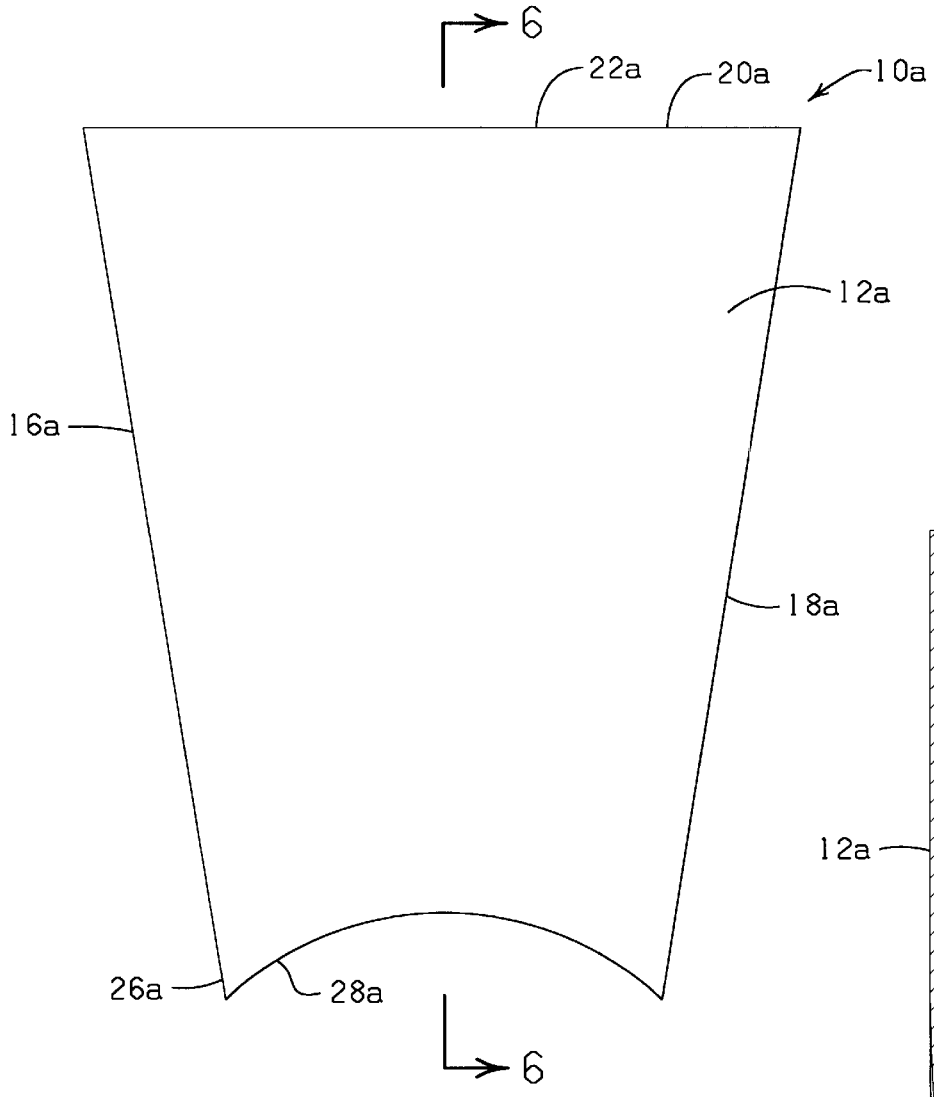
FIG. 5 is an elevational view of another embodiment of a sleeve constructed in accordance with the present invention.
Figure 6:
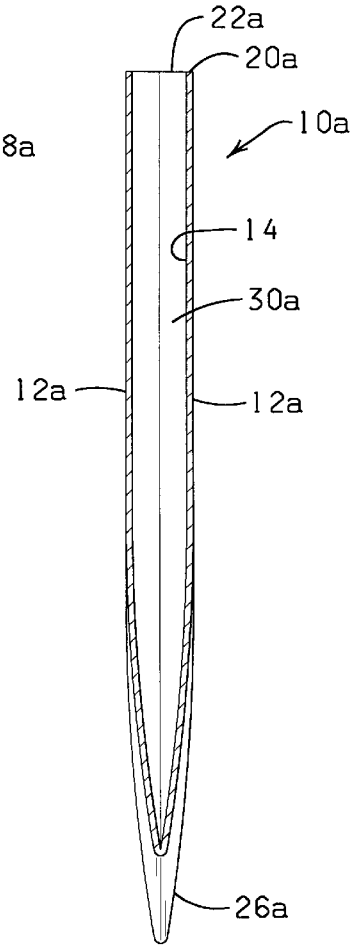
FIG. 6 is a cross-sectional view of the sleeve of FIG. 5 taken along line 6—6 thereof.

Shown in FIGS. 5–6 is a sleeve designated by the general reference numeral 10*a*. The sleeve 10*a* has an outer peripheral surface 12*a*, an inner peripheral surface 14*a*, an upper end 20*a* having an upper edge 22*a*, and an inner space 30*a*. The sleeve 10*a*, in a flattened state, also includes a first sidewall edge 16*a*, a second sidewall edge 18*a*, and a concave lower end 26*a* having an inwardly curved lower edge 28*a*. The shape of the concave lower end 26*a* may be elliptical, rounded, curvilinear, ovoid, or any other curved shape known in the art, but must be inwardly curved. The sleeve 10*a* differs from the sleeve 10 shown above primarily in that the upper edge 22*a* of the upper end 20*a* is linear rather than non-linear.

Figure 7:
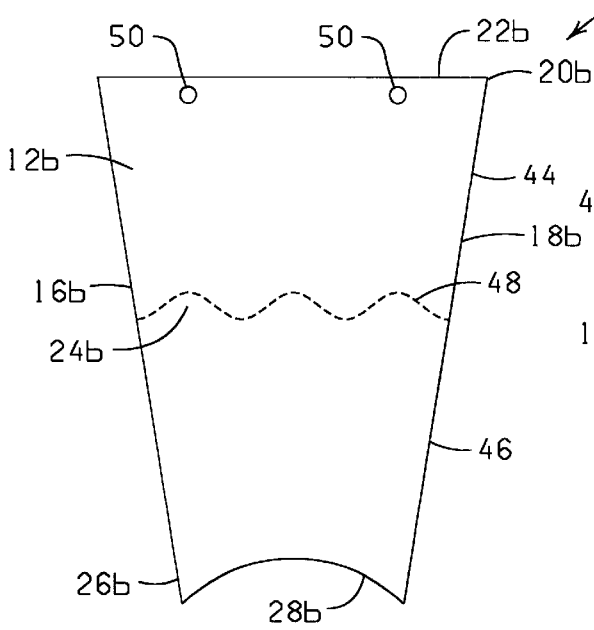
FIG. 7 is an elevational view of another embodiment of a sleeve constructed in accordance with the present invention.

Shown in FIG. 7 is a sleeve designated by the general reference numeral 10*b*. The sleeve 10*b* has an outer peripheral surface 12*b*, an inner peripheral surface (not shown), an upper end 20*b* having an upper edge 22*b*, a skirt portion 24*b*, and an inner space (also not shown). The sleeve 10*b*, in a flattened state, also includes a first sidewall edge 16*b*, a second sidewall edge 18*b*, and a concave lower end 26*b* having an inwardly curved lower edge 28*b*. The shape of the concave lower end 26*b* may be elliptical, rounded, curvilinear, ovoid, or any other curved shape known in the art, but must be inwardly curved.

The sleeve 10*b* is similar to the sleeves 10 and 10*a* shown in FIGS. 1–6, except sleeve 10*b* comprises both a lower portion 46 and an upper portion 44. The upper portion 44 is detachable from the lower portion 46 via a detaching element 48, such as perforations. The upper portion 44 is generally sized so that it can substantially surround and enclose a floral grouping, alone (not shown) or disposed within a pot disposed within the sleeve 10*b* (not shown). The upper portion 44 may have apertures 50 therein for enabling the sleeve 10*b* to be supported from a support device or assembly such as a wicket, in a manner well known to those of ordinary skill in the art.

Figure 8:
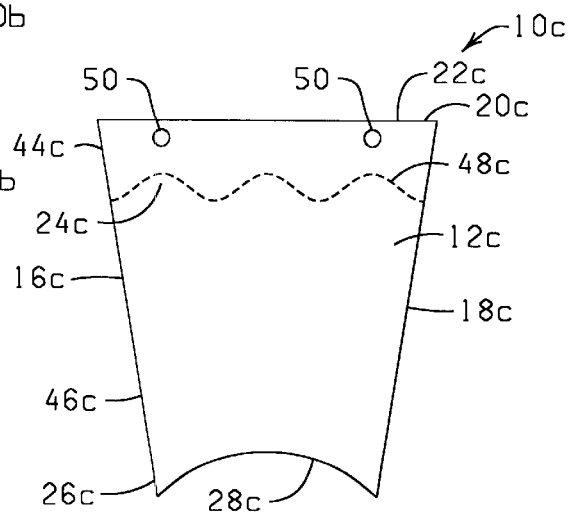
FIG. 8 is an elevational view of another embodiment of a sleeve constructed in accordance with the present invention.

Shown in FIG. 8 is a sleeve designated by the general reference numeral 10*c*. The sleeve 10*c* has an outer peripheral surface 12*c*, an upper end 20*c* having an upper edge 22*c*, a skirt portion 24*c*, and an inner space (not shown). The sleeve 10*c*, in a flattened state, also includes a first sidewall edge 16*c*, a second sidewall edge 18*c*, and a concave lower end 26*c* having an inwardly curved lower edge 28*c*. The shape of the concave lower end 26*c* may be elliptical, rounded, curvilinear, ovoid, or any other curved shape known in the art, but must be inwardly curved.

Sleeve 10*c* is similar to sleeve 10*b* in having an upper portion 44*c*, a lower portion 46*c*, a detaching element 48*c*, and optionally, apertures 50, but differs in that the upper portion 44*c* is designed to be removed from the lower portion 46*c* before the lower portion 46*c* is used to cover a pot (not shown) or a floral grouping (not shown), and further, the upper portion 44*c* is generally not sized to enclose a floral grouping.

Figure 9:
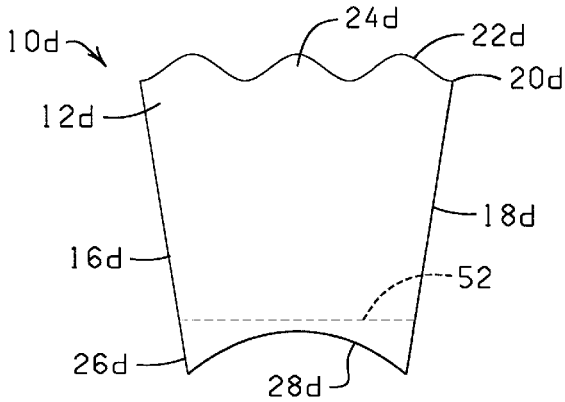
FIG. 9 is an elevational view of another embodiment of a sleeve constructed in accordance with the present invention.

Shown in FIG. 9 is a sleeve designated by the general reference numeral 10*d*. The sleeve 10*d* has an outer peripheral surface 12*d*, an inner peripheral surface (not shown), an upper end 20*d* having an upper edge 22*d*, a skirt portion 24*d*, and an inner space (also not shown). The sleeve 10*d*, in a flattened state, also includes a first sidewall edge 16*d*, a second sidewall edge 18*d*, and a concave lower end 26*d* having an inwardly curved lower edge 28*d*. The shape of the concave lower end 26*d* may be elliptical, rounded, curvilinear, ovoid, or any other curved shape known in the art, but must be inwardly curved.

The sleeve 10*d* is similar to sleeve 10 described above, except sleeve 10*d* has a gusset 52 in the concave lower end 26*d* which enables the concave lower end 26*d* to be expanded when a floral grouping (not shown) or a pot (not shown) is disposed therein. Gussets, such as gusset 52, and their construction are well known to persons of ordinary skill in the art. Therefore, further discussion of these methods of construction is not deemed necessary herein.

Figure 10:
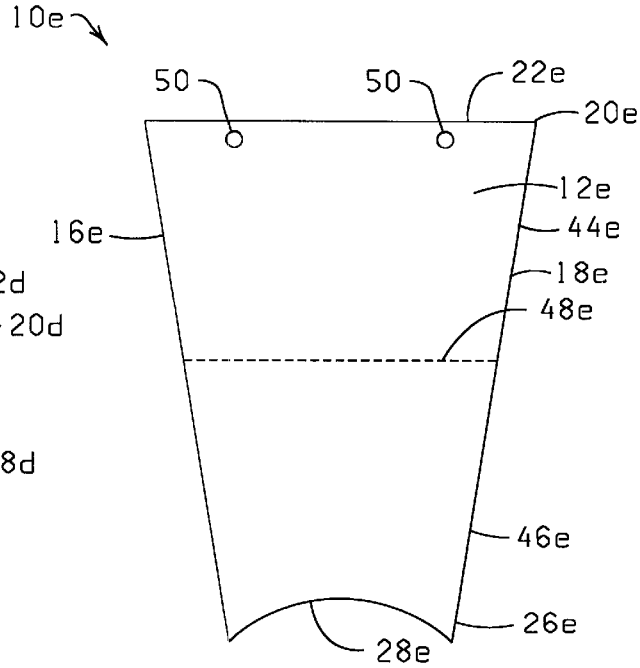
FIG. 10 is an elevational view of another embodiment of a sleeve constructed in accordance with the present invention.

Shown in FIG. 10 is a sleeve designated by the general reference numeral 10*e*. The sleeve 10*e* has an outer peripheral surface 12*e*, an inner peripheral surface (not shown), an upper end 20*e* having an upper edge 22*e*, and an inner space (also not shown). The sleeve 10*e*, in a flattened state, also includes a first sidewall edge 16*e*, a second sidewall edge 18*e*, and a concave lower end 26*e* having an inwardly curved lower edge 28*e*. The shape of the concave lower end 26*e* may be elliptical, rounded, curvilinear, ovoid, or any other curved shape known in the art, but must be inwardly curved.

The sleeve 10*e* is similar to the sleeve 10*b* in that sleeve 10*e* has an upper portion 44*e*, a lower portion 46*e*, a detaching element 48*e*, and may optionally have apertures 50. Sleeve 10*e* differs from sleeve 10*b* primarily in that the detaching element 48*e* has a linear or arcuate pattern which, when the sleeve 10*e* is in a flattened state, extends from the first sidewall edge 16*e* to the second sidewall edge 18*e*, rather than a non-linear pattern as shown for the detaching element 48 of sleeve 10*b*.

Any of the sleeves 10–10*e* contemplated herein may also be equipped with drainage elements (e.g., one or more holes) in the lower end thereof or ventilation holes (not shown), or can be made from permeable or impermeable materials.

Any thickness of material may be utilized in accordance with the present invention as long as the sleeves 10–10*e* may be formed as described herein, and as long as the sleeves 10–10*e* may contain at least a portion of a pot or floral grouping, as described herein. Additionally, an insulating material such as bubble film, preferably one of two or more layers, can be utilized in order to provide additional protection for the item, such as the floral grouping, contained therein.

The material from which the sleeves 10–10*e* described herein are constructed preferably has a thickness in a range from about 0.1 mil to about 30 mils. Often, the thicknesses of the sleeves are in a range from about 0.5 mil to about 10 mils. or preferably, in a range from about 1.0 mil to about 5 mils. More preferably, the sleeves 10–10*e* are constructed from a material which is flexible, semi-rigid, rigid, or any combination thereof. The sleeves 10–10*e* may be constructed of a single layer of material or a plurality of layers of the same or different types of materials. The layers of material comprising the sleeves 10–10*e* may be connected together or laminated or may be separate layers. Such materials used to construct the sleeves 10–10*e* are described in U.S. Pat. No. 5,111,637, which is hereby expressly incorporated herein by reference.

The sleeves 10–10*e* are constructed from any suitable material that is capable of being formed into a sleeve and wrapped about a pot and a floral grouping (or a floral grouping alone) disposed therein. Preferably, the material comprises treated or untreated paper, metal foil, polymeric film, non-polymeric film, woven or non-woven fabric, or synthetic or natural fabric, cardboard, fiber, cloth, burlap, or laminations or combinations thereof.

In one embodiment, the sleeves 10–10*e* contemplated herein may be constructed from sheets comprising two polypropylene films which may be connected together or laminated or may be separate layers. In an alternative embodiment, the sleeves 10–10*e* may be constructed from only one sheet of the polypropylene film.

The term "polymeric film" means a synthetic polymer such as a polypropylene or a naturally occurring polymer such as cellophane. A polymeric film is relatively strong and not as subject to tearing (substantially non-tearable), as might be the case with paper or foil.

The materials comprising the sleeves 10–10*e* may vary in color and, as described herein, may consist of designs or decorative patterns which are printed, etched, and/or embossed thereon using inks or other printing materials. An example of an ink which may be applied to the surface of the material is described in U.S. Pat. No. 5,147,706, which is hereby expressly incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination. Moreover, portions of the material used in constructing the sleeves 10–10*e* may vary in the combination of such characteristics. The material utilized for the sleeves 10–10*e* may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. As noted earlier, the floral grouping comprises a bloom portion and a stem portion. Further, the floral grouping may comprise a growing potted plant having a root portion (not shown). However, it will be appreciated that the floral grouping may consist of only a single bloom or only foliage, or a botanical item, or a propagule. The term "floral grouping" may be used interchangeably herein with both the terms "floral arrangement" and "potted plant". The term "potted plant" generally refers to a floral grouping and a pot along with a growing medium. The term "floral grouping" may also be used interchangeably herein with the terms "botanical item" and/or "propagule".

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as a bouquet or a floral grouping.

The term "propagule" when used herein means any structure capable of being propagated or acting as an agent of reproduction including seeds, shoots, stems, runners, tubers, plants, leaves, roots, or spores.

In accordance with the present invention a bonding material (not shown) may optionally be disposed on a portion of any of the sleeves 10–10*e* described herein, or provided separately, to attach each sleeve 10–10*e* to a pot having a floral grouping therein and disposed within the sleeve 10–10*e*. The bonding material may alternatively be a band, tie, string, ribbon, wire, tape, heat shrinkable material or other tying or banding device which may be constructed within or attached to the sleeve 10–10*e* before it is applied about the pot or floral grouping or may be provided only after the sleeve 10–10*e* is applied about the pot or floral grouping. A separate bonding material may also assist in closing or sealing the upper portion (when present) of the sleeve 10–10*e* or in adhering the sleeve 10–10*e* to the pot after the pot has been disposed therein. Examples of how a bonding material may be disposed on the sleeve are shown in U.S. Pat. Nos. 5,493,809 and 5,625,979, both of which are hereby expressly incorporated herein by reference in their entirety.

The term "detaching element" when used generally herein, means any element or device such as, but not limited to, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching element" known in the art, or any combination thereof, could be substituted therefore and/or used therewith.

Each of the upper portions 44, 44*c* or 44*e* of the sleeves 10*b*, 10*c* and 10*e*, respectively, may also have an additional substantial vertically disposed detaching element comprising a plurality of vertical perforations (not shown but well known in the art) for facilitating removal of the upper portion 44, 44*c* or 44*e* from the lower portion 46, 46*c* or 46*e*, respectively.

As indicated above, it will be understood by a person of ordinary skill in the art that equipment and devices for forming floral sleeves are commercially available, and are well known to a person of ordinary skill in the art. Further detailed discussion of the construction of the sleeves described herein therefore is not deemed necessary. However, briefly, the sleeves described herein may be formed by intermittently advancing two separate webs, one or two webs preformed in the form of a tube, or a single web folded double and sealing the longitudinal sides and bottom portions of the two facing panels then cutting the sleeve thus formed from the webs or web. Machines which can form sleeves from such single webs or pairs of webs are well within the knowledge of one of ordinary skill in the art.

As noted above, any of the sleeves 10–10*e* contemplated herein may have a lower end 26–26*e*, respectively, which is open or closed. When the lower end 26–26*e* is closed, the lower end 26–26*e* may have one or more gussets 52, as described elsewhere herein, formed therein for allowing expansion of the lower end 26–26*e* when an object with a broad lower end, such as a pot, is disposed therein. In another version, the sleeve 10–10*e* may include a flap (not shown) which can be folded over and sealed with a bonding material to close the sleeve 10–10*e* .

The term "pot" or "flower pot," as used herein, refers to any type of container used for holding a floral grouping or plant, including vases. Examples of pots, used in accordance with the present invention include, but not by way of limitation, clay pots, wooden pots, plastic pots, foam pots, pots made from natural and/or synthetic fibers, and/or any combination thereof. The pot is adapted to receive a floral grouping in a retaining space thereof. The floral grouping may be disposed within the pot along with a suitable growing medium described elsewhere herein, or other retaining medium, such as a floral foam. It will also be understood that the floral grouping, and any appropriate growing medium or other retaining medium, may be disposed in the sleeve without a pot for cultivating the floral grouping or displaying a grown floral grouping or botanical item.

It should also be noted that for all versions of sleeves described above which have a bonding material thereon, it may be desirable to have a release material or cover strip covering the adhesive or cohesive bonding material disposed on any portion of such sleeves for preventing the bonding material from bonding to another surface until such is desired. Further, in each of the cases described herein wherein a sleeve is applied to a pot, the sleeve may be applied thereto either by depositing the pot downwardly into the opened sleeve, or the sleeve may be brought upwardly about the pot from below the pot.

It should be further noted that various features of the versions of the present invention such as closure bonding areas, support apertures, handles or handle apertures, additional perforations, drainage elements, ventilation holes, combinations of material may be used alone or in combination as elements of any of the embodiments described above herein.

Changes may be made in the construction and the operation of the various components, elements and assemblies described herein or in the steps or the sequence of steps of the methods described herein without departing from the spirit and scope of the invention as defined in the following claims.

What is claimed is:

1. A method of covering a pot or floral grouping comprising:

providing a sleeve initially having a flattened state, and openable to an opened state and in the flattened state comprising:

an outer peripheral surface, an inner peripheral surface, a first sidewall edge, a second sidewall edge, an upper end having an upper edge, and a concave lower end having an inwardly curved lower edge, and the sleeve further comprising an inner space in the opened state:

opening the sleeve to expose the inner space thereof; and disposing a pot or floral grouping into the inner space of the sleeve.

2. The method of claim 1 wherein in the step of providing a sleeve the concave lower end of the sleeve has a shape which is elliptical, curvilinear, rounded or ovoid.

3. The method of claim 1 wherein in the step of providing a sleeve the sleeve comprises a gusset in the concave lower end of the sleeve.

4. The method of claim 1 wherein in the step of providing a sleeve the sleeve further comprises a detaching element for enabling detachment of an upper portion of the sleeve from a lower portion of the sleeve.

5. The method of claim 4 wherein in the step of providing the sleeve the detaching element comprises perforations.

6. The method of claim 4 wherein in the step of providing the sleeve the detaching element has a non-linear pattern such that when the upper portion is detached, the lower portion is left with an upper end having a non-linear upper edge.

7. The method of claim 4 wherein in the step of providing the sleeve the detaching element has a linear pattern such that when the upper portion is detached, the lower portion is left with an upper end having a linear upper edge.

8. The method of claim 4 wherein in the step of providing the sleeve the upper portion is sized to substantially surround and enclose the flora grouping.

9. The method of claim 4 wherein in the step of providing the sleeve the upper portion is adapted to support the sleeve from a support element.

10. The method of claim 1 wherein in the step of providing the sleeve the sleeve further comprises a skirt portion.

11. The method of claim 1 wherein in the step of providing the sleeve the sleeve has a generally frusto-conical shape when in the opened state.

12. The method of claim 1 wherein in the step of providing the sleeve the upper edge of the upper end of the sleeve in non-linear.

13. The method of claim 1 wherein in the step of providing the sleeve the upper edge of the upper end of the sleeve in linear.

14. A method of covering a pot or floral grouping, comprising:

providing a sleeve initially having a flattened state and openable to an opened state, and in the flattened state comprising:

an outer peripheral surface, in inner peripheral surface, a first sidewall edge, a second sidewall edge, an upper end having an upper edge, and a concave lower end having an inwardly curved lower edge, and the sleeve further comprising an inner space in the opened state, and the sleeve having a detaching element extending from the first sidewall edge to the second sidewall edge for detaching an upper portion of the sleeve from a lower portion of the sleeve;

opening the sleeve to expose the inner space thereof; and disposing a pot or floral grouping into the inner space of the sleeve.

15. The method of claim 14 wherein in the step of providing the sleeve the concave lower end of the sleeve has a shape which is elliptical, curvilinear, rounded or ovoid.

16. The method of claim 14 wherein in the step of providing the sleeve the sleeve comprises a gusset in the concave lower end of the sleeve.

17. The method of claim 14 wherein in the step of providing the sleeve the detaching element comprises perforations.

18. The method of claim 14 wherein in the step of providing the sleeve the detaching element has a non-linear pattern such that when the upper portion is detached, the lower portion is left with an upper end having a non-linear upper edge.

19. The method of claim 14 wherein in the step of providing the sleeve the detaching element has a linear pattern such that when the upper portion is detached, the lower portion is left with an upper end having a linear upper edge.

20. The method of claim 14 wherein in the step of providing the sleeve the upper portion is sized to substantially surround and enclose the floral grouping.

21. The method of claim 14 wherein in the step of providing the sleeve the upper portion is adapted to support the sleeve from a support element.

22. The method of claim 14 wherein in the step of providing the sleeve the sleeve further comprises a skirt portion.

23. The method of claim 14 wherein in the step of providing the sleeve the sleeve has a generally frusto-conical shape when in the opened state.

* * * * *